US007210736B1

(12) United States Patent
Large

(10) Patent No.: US 7,210,736 B1
(45) Date of Patent: May 1, 2007

(54) TRAY ATTACHMENT FOR WHEELCHAIRS

(76) Inventor: Richard L. Large, 9505 S. 27th St., Lincoln, NE (US) 68512

( * ) Notice: Subject to any disclaimer, the term of this patent is extended or adjusted under 35 U.S.C. 154(b) by 85 days.

(21) Appl. No.: 11/154,026

(22) Filed: Jun. 16, 2005

Related U.S. Application Data

(60) Provisional application No. 60/580,826, filed on Jun. 18, 2004.

(51) Int. Cl.
*A47B 83/02* (2006.01)

(52) U.S. Cl. ..... 297/155; 297/148; 297/150; 297/154; 297/160; 297/162; 297/170; 297/173; 297/174 R

(58) Field of Classification Search ..... 297/135, 297/160, 162, 170, 173, 174 R, 148, 150, 297/154, 155
See application file for complete search history.

(56) References Cited

U.S. PATENT DOCUMENTS 289,384 A * 12/1883 Byrkit ..... 297/170 X
319,105 A * 6/1885 McClure ..... 297/170 X
331,149 A * 11/1885 McClure ..... 297/170 X
517,633 A * 4/1894 Wertheimer ..... 297/170
646,835 A * 4/1900 Jackson ..... 297/170 X
811,480 A * 1/1906 Camfield ..... 297/170 X
818,917 A * 4/1906 Ruger ..... 297/173
993,493 A * 5/1911 Young ..... 297/170 X
1,185,391 A * 5/1916 Fowler ..... 297/170 X
1,211,527 A * 1/1917 Berndt ..... 297/170 X
1,232,757 A * 7/1917 Berkey ..... 297/170 X
1,413,745 A * 4/1922 Leonard ..... 297/170 X
2,650,651 A * 9/1953 Choate ..... 297/160 X
2,677,211 A * 5/1954 Luketa ..... 297/170 X
2,954,955 A * 10/1960 Feller ..... 297/170 X
3,099,479 A * 7/1963 Banke ..... 297/162 X
3,575,466 A 4/1971 Thomas et al. ..... 297/155
3,860,285 A 1/1975 Hartman ..... 297/150
3,870,362 A 3/1975 Large ..... 297/155
4,428,616 A 1/1984 Hamilton ..... 297/145
4,566,732 A * 1/1986 Ostergaard et al. ..... 297/174 R
4,662,676 A * 5/1987 Havelock ..... 297/160
4,685,726 A * 8/1987 Wolpert, Jr. ..... 297/162 X
4,779,884 A 10/1988 Minati ..... 280/289 WC
4,878,685 A * 11/1989 Bahm ..... 297/162 X (Continued)

FOREIGN PATENT DOCUMENTS

DE 4140045 A1 * 6/1993 ..... 297/162

(Continued)

*Primary Examiner*—Rodney B. White
(74) *Attorney, Agent, or Firm*—Suiter Swantz pc llo

(57) ABSTRACT

A tray attachment for a wheelchair. In an embodiment, the tray attachment includes a mounting tube for mounting the tray to a wheelchair. Further, a slider extension tube is disposed within the mounting tube for supporting the tray. In addition, a first ball knob assembly is mechanically coupled to the slider extension tube for supporting the tray. Moreover, a second ball knob assembly is mechanically coupled to the slider extension tube for supporting the tray. In the present aspect, the slider extension tube rotates as the tray is moved from a stored position to a utilization position, such rotation places the first ball knob assembly adjacent to an edge of the tray and the second ball knob assembly beneath the tray, thereby providing lateral and vertical support to the tray on the attachment side.

20 Claims, 5 Drawing Sheets

U.S. PATENT DOCUMENTS

| | | | | | |
|---|---|---|---|---|---|
| 5,139,309 | A | | 8/1992 | Kornreich | 297/194 |
| 5,228,711 | A | | 7/1993 | Summers | 280/304.1 |
| 5,333,929 | A | * | 8/1994 | Slagerman | 297/162 X |
| 5,454,581 | A | * | 10/1995 | Ringer | 297/162 X |
| 5,567,080 | A | | 10/1996 | Sterlacci | 403/322 |
| 5,765,911 | A | * | 6/1998 | Sorenson | 297/173 |
| 5,842,745 | A | | 12/1998 | Kelly et al. | 297/411.23 |
| 5,893,607 | A | * | 4/1999 | Trimnell | 297/170 |
| 6,224,149 | B1 | * | 5/2001 | Gevaert | 297/162 |
| 6,375,257 | B1 | * | 4/2002 | Wooding et al. | 297/162 |
| 6,702,373 | B2 | * | 3/2004 | Rossko | 297/173 |
| 6,722,681 | B1 | | 4/2004 | Large | 280/304.1 |
| 2004/0207238 | A1 | * | 10/2004 | Tornero et al. | 297/173 |

FOREIGN PATENT DOCUMENTS

| | | | | |
|---|---|---|---|---|
| WO | WO 8705478 | A1 * | 9/1987 | 297/162 |

* cited by examiner

TRAY ATTACHMENT FOR WHEELCHAIRS

CROSS REFERENCE TO RELATED APPLICATIONS

The present application claims the benefit under 35 U.S.C. § 119(e) of U.S. Provisional Patent Application Ser. No. 60/580,826 entitled "Tray Attachment for Wheelchairs" filed Jun. 18, 2004 which is herein incorporated by reference in its entirety.

FIELD OF INVENTION

The present invention generally relates to the field of wheelchairs and particularly to a tray attachable to a wheelchair.

BACKGROUND OF THE INVENTION

U.S. Pat. No. 6,722,681 B1 granted to Applicant on Apr. 20, 2004 describes a tray for attachment to a wheelchair and is hereby incorporated by reference in its entirety. There are thousands of conventional and motorized wheelchairs in service and each of the people who are confined to a wheelchair needs the convenience of having a tray at their disposal. Since a wheel chair is mobile, the wheel chair and its occupant travel from place to place. If the tray is not attached to the chair, the tray may be left in a location to which the occupant and/or caregiver must return in order to obtain and utilize the tray.

Many types of trays which are removable from the armrest of a wheelchair are in use; however, they have their limitations in that they must be removed from the wheelchair prior to the time that the occupant can be removed from the wheelchair. There is accordingly a need for a wheelchair having a storable tray thereon wherein the tray can be stored at the side of the chair on a continuous basis without affecting the operation of the wheelchair and which when needed can be returned to its utilization position without affecting the operation of the wheelchair. The tray assembly of U.S. Pat. No. 6,722,681 B1 met this need by providing a tray which is movable between a utilization position and a storage position while still allowing an occupant of the chair assembly to use the chair assembly in its fullest capacity.

In the present invention, the tray assembly as represented by U.S. Pat. No. 6,722,681 B1 has been further improved to provide a more practical lateral and vertical support to the tray in the utilization position and other mechanisms for attaching the tray to a manual or motorized device or chair having armrests. The tray vertical support mechanism may be improved for most basic motorized or conventional wheelchairs, whether of the standard or desk type arm design or whether the chair with arms is stationary or whether the device with arms is a platform used and/or occupied by the user. The support for the portion of the tray farthest from the occupant is lacking in the design described in U.S. Pat. No. 6,722,681 B1. The design may be improved by having the support for the portion of the tray farthest from the occupant be retractable instead of stationary as was described in the U.S. Pat. No. 6,722,681 B1. Such configuration overcomes the problem of support members protruding into the area used by the occupant in getting in and out of the wheelchair. Additionally the lateral support for the tray covered under U.S. Pat. No. 6,722,681 B1 is provided in an alternative configuration in which the tray arm is attached opposite the pivot arm to the rear of the chair preventing the tray from rotating and/or moving forward.

That tray design may be used as a restraint if required by doctor's orders, however it may be perceived as a restraint when not needed and therefore the tray may not be utilized.

Therefore, a more practical design is presented by the present invention in order to provide a more practical vertical support and adequate lateral support needed by the majority of users.

SUMMARY OF THE INVENTION

Accordingly, the present invention is directed to a novel tray vertical and lateral support for the tray covered under U.S. Pat. No. 6,722,681 B1. In a first aspect of the present invention, a tray attachment for a wheelchair includes a mounting tube for mounting the tray to a wheelchair. Further, a slider extension tube is disposed within the mounting tube for supporting the tray. In addition, a first ball knob assembly is mechanically coupled to the slider extension tube for supporting the tray. Moreover, a second ball knob assembly is mechanically coupled to the slider extension tube for supporting the tray. In the present aspect, the slider extension tube rotates as the tray is moved from a stored position to a utilization position, such rotation places the first ball knob assembly adjacent to an edge of the tray and the second ball knob assembly beneath the tray, thereby providing lateral and vertical support to the tray.

In accordance with specific aspects of the present tray attachment, the tray is mounted to the wheel chair by the mounting tube being mechanically coupled to a wheelchair armrest tube or support. Further, in an aspect, the first ball knob assembly and the second ball knob assembly are coupled to the slider extension tube on a forward side of the mounting tube. Moreover, the stored position of the tray may be supported by the first ball knob assembly, while in the utilization position, the tray is laterally supported by the first ball knob assembly and vertically supported by the second ball knob assembly. In an additional aspect, a swivel assembly is included for coupling the slider extension tube to the tray. The swivel assembly may be coupled to the slider extension tube via a right angle extension. In a further aspect, a forward edge tray support is included on the opposite side for providing vertical support to the forward edge of the tray. For example, the tray support assembly includes at least two tubes coupled to one another by at least two sets of clamps.

In accordance with another aspect of the present invention, a tray assembly for a wheelchair is disclosed. In the aspect, the tray assembly includes a tray for providing a working surface area. Further, the tray assembly includes a tray attachment for attaching the tray to the wheelchair. The tray attachment may include the following: a mounting tube for mounting the tray to a wheelchair, a slider extension tube disposed within the mounting tube for supporting the tray; a first ball knob assembly mechanically coupled to the slider extension tube for supporting the tray; and a second ball knob assembly mechanically coupled to the slider extension tube for supporting the tray. The slider extension tube rotates as the tray is moved from a stored position to a utilization position, such rotation places the first ball knob assembly adjacent to an edge of the tray and the second ball knob assembly beneath the tray, thereby providing lateral and vertical support to the tray.

BRIEF DESCRIPTION OF THE DRAWINGS

Features, improvements and advantages of the present invention will become more apparent from the following detailed description, appended claims and the accompanying drawings in which:

DETAILED DESCRIPTION OF THE INVENTION

Reference will now be made in detail to the presently preferred embodiments of the invention, examples of which are illustrated in the accompanying drawings.

Figure 1:
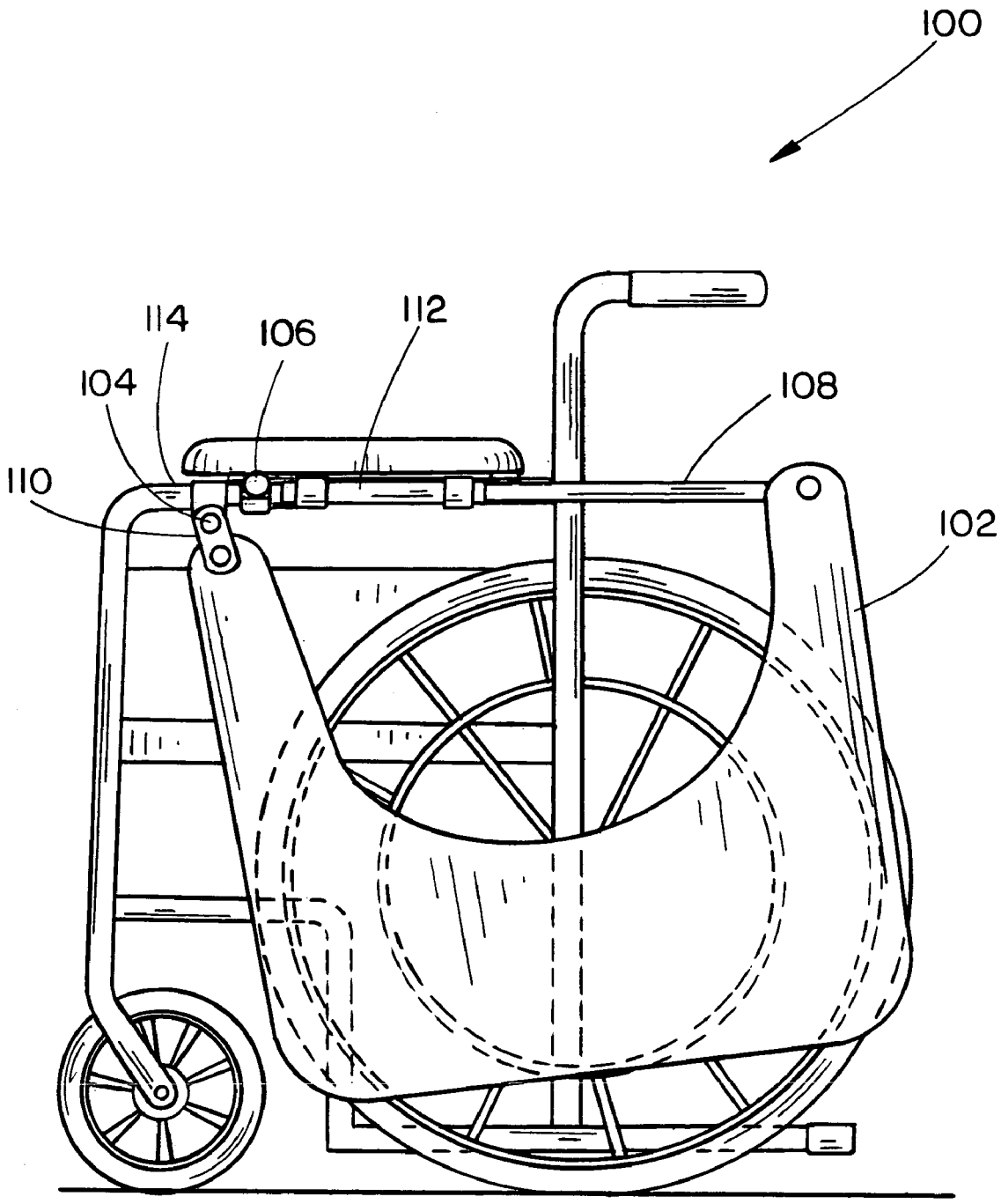
FIG. 1 is a left side elevation view of a wheelchair assembly in accordance with an exemplary embodiment of the present invention, wherein the wheelchair includes a tray in the storage position.

Referring now to FIGS. 1 through 6, a tray attachment for a wheelchair in accordance with exemplary embodiments of the present invention is provided. As illustrated in FIG. 1, a tray 102 is secured to a wheelchair for providing a work surface and the like. For example, the tray 102 may be employed by a wheelchair occupant to eat, rest ones arms or head, perform projects, and the like. In an exemplary embodiment, the tray 102 is attached to the wheelchair by a tray attachment. In such embodiment, the tray attachment includes a mounting tube 112 for mounting the tray 102 to a wheelchair. The mounting tube 112 may be adjusted along the length of a wheelchair armrest tube 114 and the mounting tube 112 may be of various lengths to accommodate the size of the occupant and to position the stored tray 102 with respect to a front wheel or the like and to allow the occupant access to the wheel propelling rim if necessary (for non-motorized wheelchairs).

Further, in an exemplary embodiment, a slider extension member or tube 108 is disposed within the mounting tube 112 for supporting the tray 102. For example, as illustrated in FIG. 1, the slider extension tube 108 is attached to tray 102 by a swivel assembly. In an embodiment, the slider extension tube 108 passes through the mounting tube 112 which is secured (e.g., clamped) to the wheelchair by a wheelchair armrest tube 114.

In addition, the present embodiment of the tray attachment includes a first ball knob assembly or lateral support assembly 104 mechanically coupled to the slider extension tube 108 for supporting the tray 102. In an embodiment, the first ball knob assembly 104 is mounted on the slider extension tube 108 so that the clamp portion is turned 180 degrees from the clamp of the second ball knob assembly 106 used to provide vertical stability. When rotated into place, the lateral stability ball knob assembly (e.g., the first ball knob assembly) will be located at the outside edge of the tray 102.

Figure 4B:
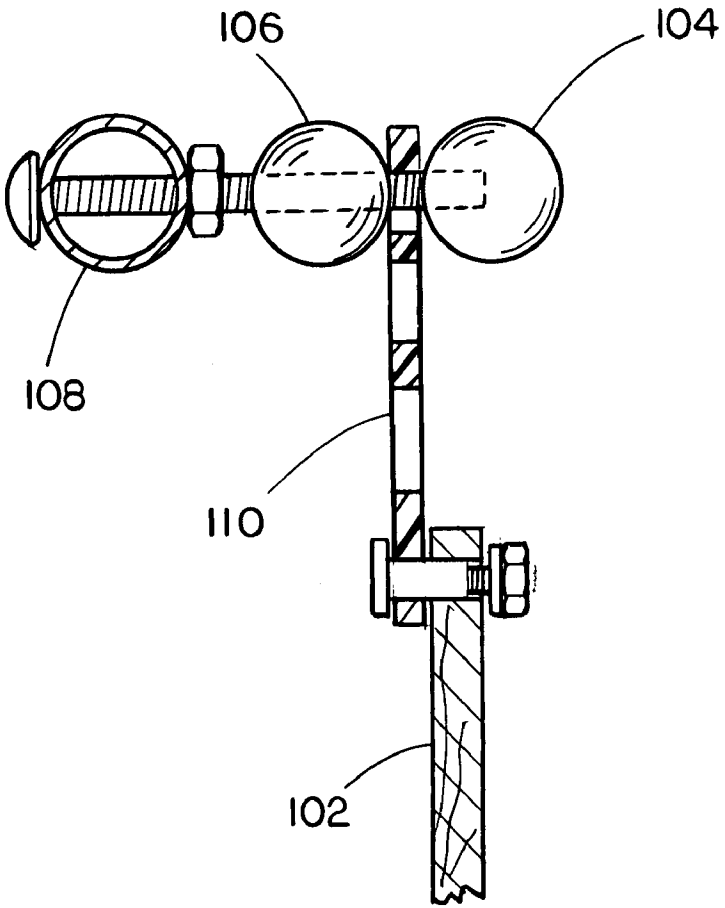
FIG. 4B is an alternative configuration of a tray attachment in accordance with an exemplary embodiment of the present invention; wherein the tray attachment includes a slider extension tube, vertical support bolt and ball, and lateral support bolt and ball and hanger connector and tray arm, wherein the lateral and vertical support bolts are inserted in apertures in the slider tube.
Figure 4A:
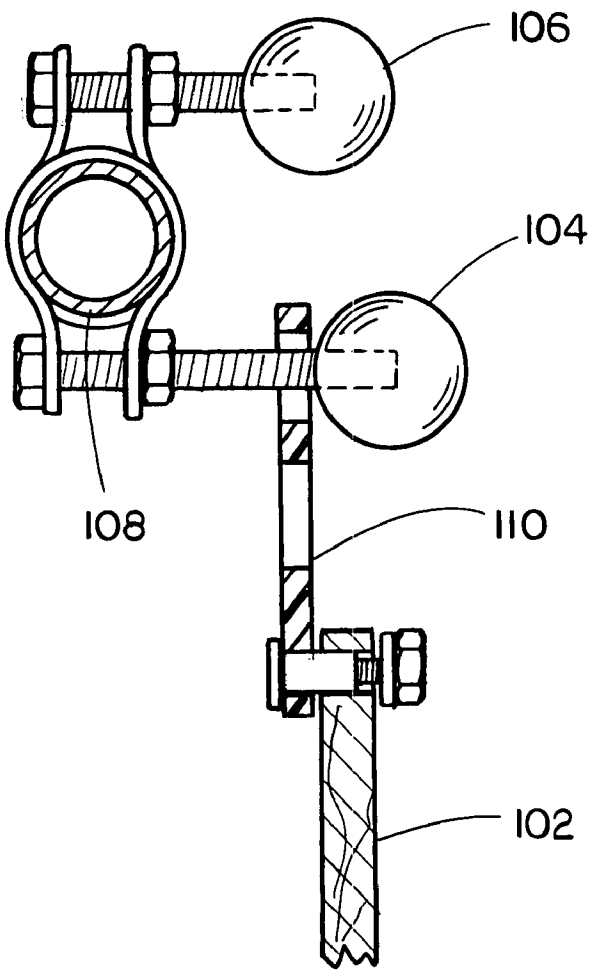
FIG. 4A is a side end view of a tray attachment in accordance with an exemplary embodiment of the present invention, wherein the tray attachment includes slider extension tube, vertical support ball clamp assembly, the ball clamp combination hanger and lateral support assembly and the hanger connection and tray arm.

In an embodiment, the location of the first ball knob assembly 104 allows the tray to be supported in the storage position and a forward corner of the tray 102 to be radiused such that the lateral ball knob 104 contacts the tray 102 on the radiused forward corner of the tray 102 in the utilization position. Additionally, as illustrated in FIG. 4B, the vertical support ball knob bolt clamp may be deleted and the vertical ball knob bolt inserted in an aperture of slider extension tube 108 generally a few inches rearward of the lateral ball knob support, which will support the tray on the underside of the tray's outside forward edge when the tray is placed in the utilization position.

Figure 5:
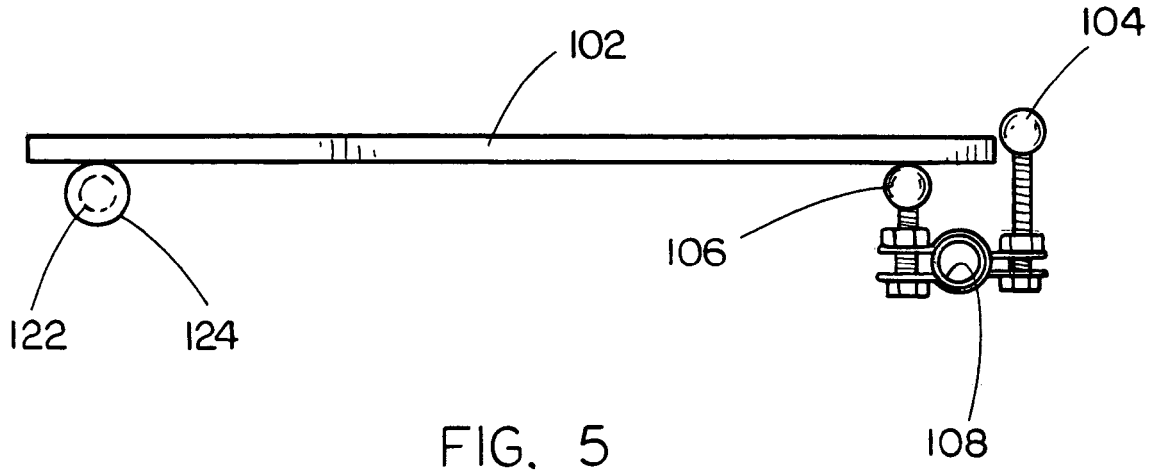
FIG. 5 is a side end elevation view of the front edge of a tray with the relative orientation of the lateral support and both vertical supports in accordance with an exemplary embodiment of the present invention, wherein clamps are utilized as part of the support assembly.
Figure 6:
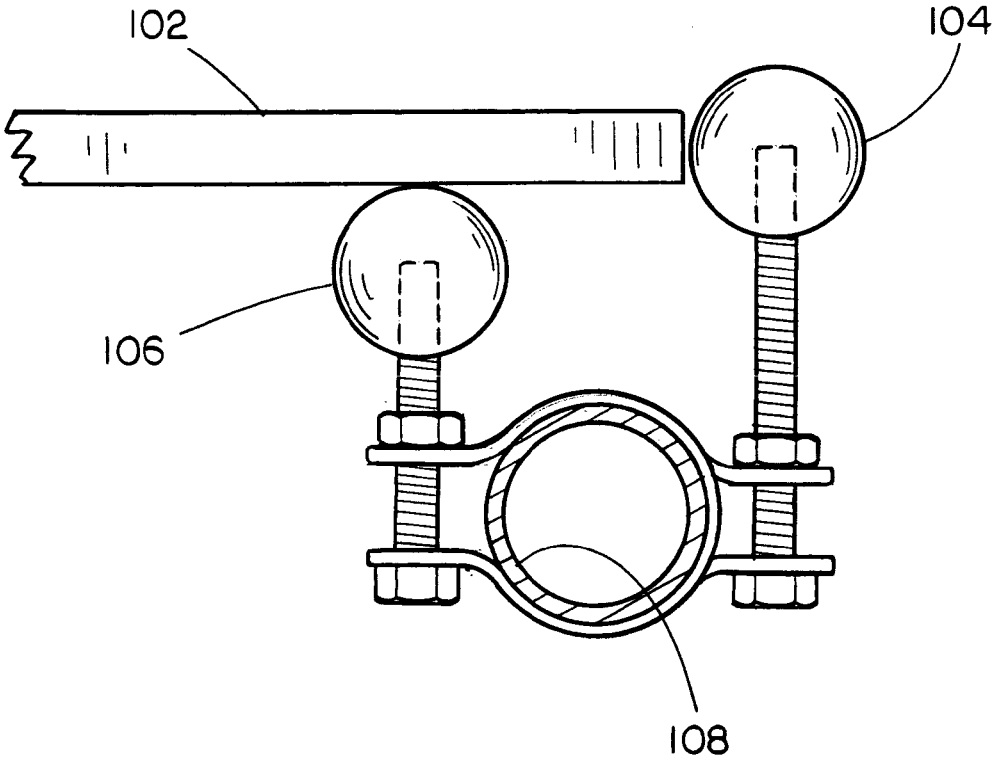
FIG. 6 is a side-elevation view of the right side of the tray illustrated in FIG. 5, wherein the relationship of the slider extension tube, clamp and ball knob assemblies, and tray are illustrated.

Additionally, in an embodiment, a second ball knob assembly or vertical support assembly 106 is included on the same slider extension tube or member 108 for providing vertical support to the tray. Such assembly 106 is closer to the swivel assembly end and is shorter in length than the first ball knob assembly 104. As illustrated in FIG. 1, bail knob assemblies 104 and 106 may be affixed to the slider extension tube 108 on the forward side of the mounting tube 112. For example, the first ball knob assembly 104 supports the tray 102 when the tray 102 is in a stored position. Further, in the utilization position the tray 102 is laterally supported by the first ball knob assembly 104 and supported vertically by the second ball knob assembly 106 as shown in FIGS. 5 and 6. It is contemplated that additional mechanisms may be employed to provide vertical support to the tray including a slider extension member similar to the slider extension tube 108 which is attached to the tray 102. The slider extension member may allow the tray support to be withdrawn when not in use to make getting into and out of the chair easier In the present embodiment, the slider extension tube 108 rotates as the tray 102 is moved from a stored position to a utilization position, such rotation places the first ball knob assembly 104 adjacent to an edge of the tray 102 and the second ball knob assembly 106 beneath the tray 102, thereby providing lateral and vertical support to the tray 102. For example, when the tray 102 is put in the storage position, the tray 102 is retracted by moving the slider extension tube 108 rearward, the maximum distance is reached when the vertical support device (e.g., a ball knob assembly) mounted on the slider extension tube 108 contacts an end of the mounting tube 112. Further, when the tray 102 is moved from the storage position to the utilization position the assemblies 104 and 106 rotate 90 degrees from an approximate horizontal position to an approximate vertical orientation. In addition, the outer edge of the tray may be lifted slightly to disengage the tray so the tray may rotate over the top of the ball knob 104 to be put in the storage position.

FIG. 1 shows the ball knob assemblies 104 and 106 clamped to the slider extension tube 108. In an embodiment, the first ball knob assembly 104 performs two functions, it is the hanger for holding the tray 102 in the storage position and acts as a lateral rotation stop for the tray when the tray is in the utilization position, see FIGS. 5 and 6. In the embodiment, a strap 110 may be utilized with the first ball knob assembly 104 to allow the ball knob assembly to serve as a hanger of the tray 102 in the storage position. The ball knob assemblies 104 and 106 rotate into a vertical position when the tray 102 is moved from the storage to the utilization position because the tray 102 is attached to the slider extension tube 108 by a swivel assembly attached to slider extension tube 108 by a right angle extension. The bolts for assemblies 104 and 106 are of different lengths to allow both lateral and vertical support.

Figure 2A:
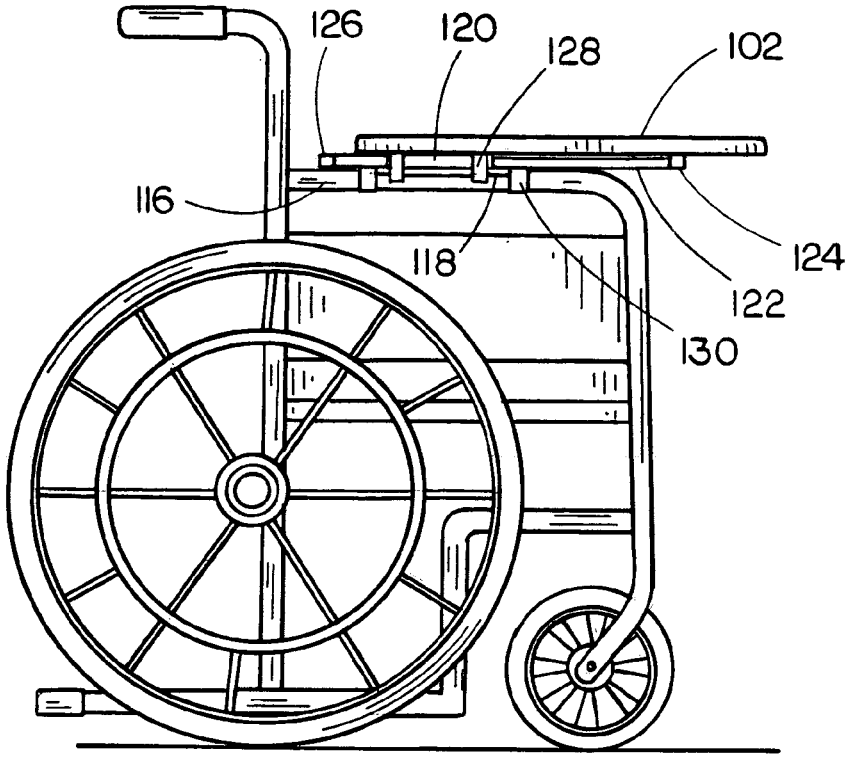
FIG. 2A is a right side elevation view of a wheelchair assembly in accordance with an exemplary embodiment of the present invention, wherein the wheelchair includes a tray in the utilization position.
Figure 2B:
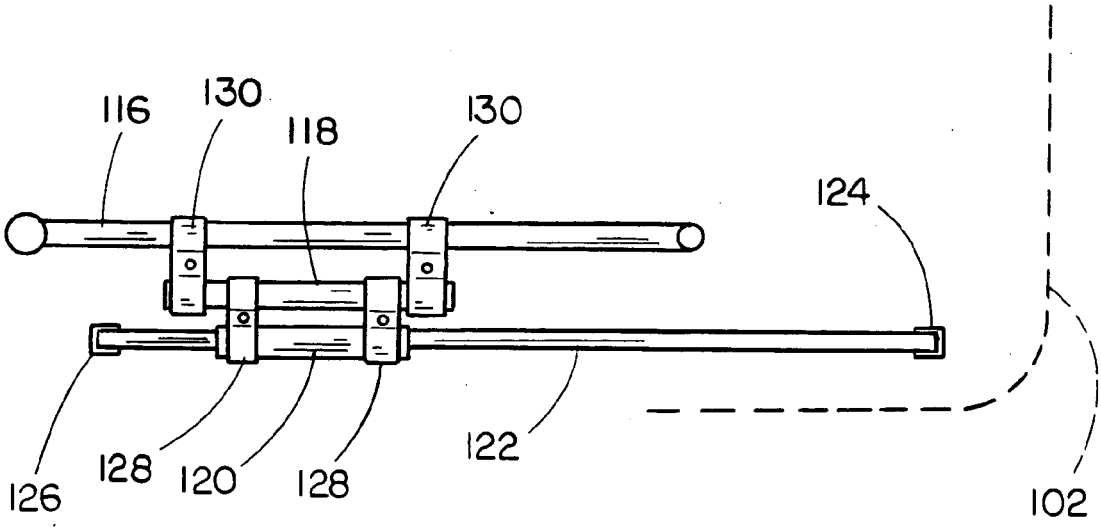
FIG. 2B is a view of the right side tray support assembly in accordance with an exemplary embodiment of the present invention.
Figure 3:
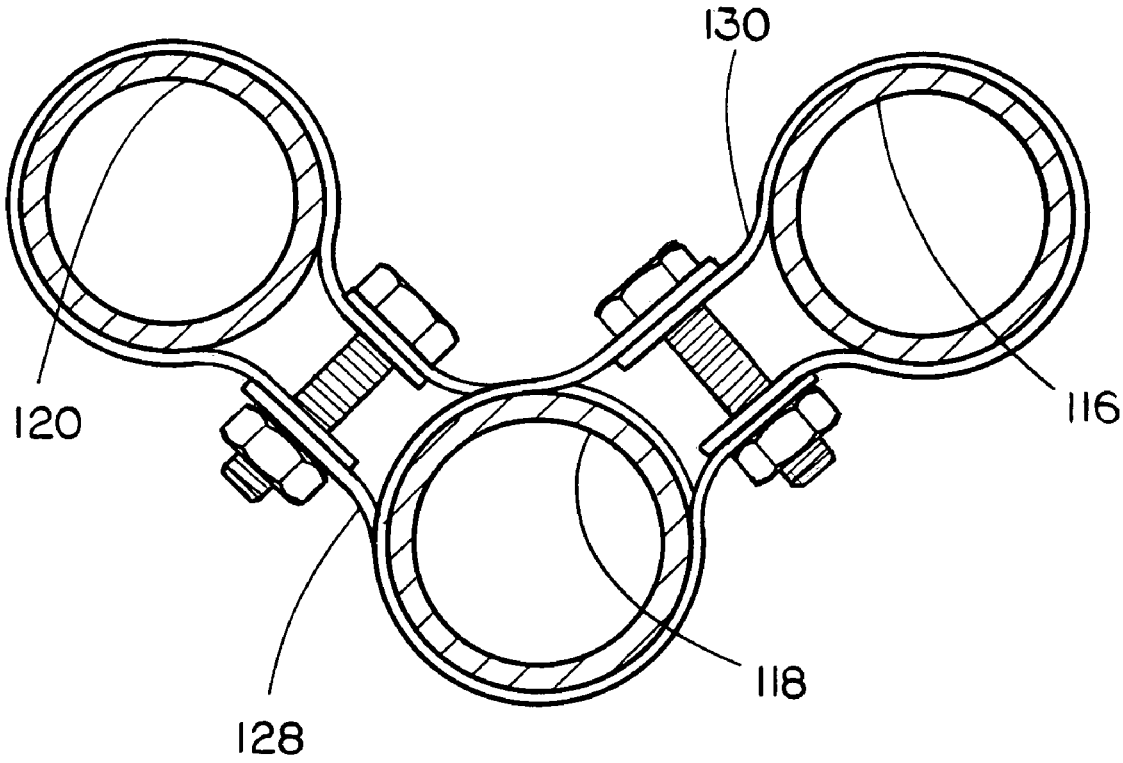
FIG. 3 is an end view of the support assembly shown in FIG. 2B, wherein the assembly may be rotated with respect to each tube to increase or decrease the operating height and horizontal location of the slider extension tube to provide optimal support to the tray.

In an embodiment, the tray support assembly on the opposite side of the chair includes two tubes 118 and 120 coupled together by clamps 128 and clamps 130, see FIG. 2B. FIG. 2B illustrates that tube 118 may be attached to the wheelchair arm rest tube 116 by the two sets of clamps 130. For example, the two tubes 118 and 120 are five to ten inches in length, one of the tubes is two to three inches shorter than the other, which are attached together with two sets of clamps. In the present example, the longer tube 118 is attached to the wheelchair armrest tube 116 with two sets of clamps. The slider extension tube 122 is inserted in the shorter mounting tube. These clamps allow the tubes 116, 118, and 120 to be adjusted rotationally to obtain the desired height of tube 122. As a result the two tubes 118 and 120 may be rotated with respect to the wheelchair armrest tube 116 and to each other to vary the height of the slider extension tube 122 inserted in tube 120 so that the end of the slider extension tube 122 may support that side of the tray 102. Additionally, this combination of tubes and clamps not only allows the vertical height to be adjusted, but allows the support to be adjusted horizontally for varying sized trays (e.g., wider or narrower trays) or when the tray has been placed on a chair with a lesser distance between the armrest support tubes.

In further embodiments, slider extension tube 122 is inserted into tube 120. When tube 122 is not being used to support the outer portion of the tray 102, it may be retracted toward the rear of the wheelchair, hence moving it away from the area the occupant uses to enter or leave the wheelchair. In additional embodiments, an endcap 124 is located on the outer end of the tube 122 and acts as a support point for the tray 102. It is contemplated that the endcap 124 may be formed of various materials such as rubber, plastic, and the like. Further, the endcap 124 may be formed by employing a device similar to that used for crutch tip. In addition, a stop 126 may be included on the opposite end of tube 122 to secure the tube 122 within tube 120 and thus, preventing tube 122 from being pulled out of tube 120. Thus, the combination of the second ball knob assembly 106 and support 124 located on slider extension tube 122 provide support for the tray 102, whether used with motorized wheelchairs with arms, normal armrest wheelchairs, or with wheelchairs having shortened armrests such as found on wheelchairs with desk type armrests.

It is contemplated that manufacturers and the like may desire to add a stationary tube to which a slider extension tube is inserted later, at the time of fabrication of the wheelchair, stationary chair or other device which has arms. It is contemplated that such step and system is encompassed within the present disclosure. Such configuration may be achieved by attaching (by welding or other methods) the clips or attachment points to the wheelchair armrest tube so that the stationary tube may be installed later or by attaching the stationary tube permanently at the time of manufacture. This initial step by the manufacture or the like may save time and effort of the clamping installation. In the present embodiment, the stationary tube in which the slider extension tube is placed is attached to the armrest tube by use of permanently attached clips (such as by welding, adhesive, and the like). In such an embodiment, a first clip is positioned on the armrest tube and another on the stationary tube so that the mechanism for rotating the tube to adjust for height is retained the same as if the stationary tube were attached by clamps. Further, the tube which is attached to the opposite arm rest tube may be attached in the same manner. Such configuration allows the original equipment manufacturer (OEM) to provide the attachment mechanisms so that the arm rest pad does not have to be loosened or removed and replaced. Thus, this configuration may result in a considerable savings in labor and clamping parts while still retaining the same motion which allows vertical adjustment of the mechanisms of either side of the chair and may also allow the tray to be mounted on either side of the chair. In addition, the clips (which may have an aperture to receive a bolt or the like) on the armrest tubes and the tubes affixed to the armrest tubes are oriented vertically so that the clipped joint may be loosened and rotated for vertical adjustment. With this arrangement, the right and left side assemblies may be entirely preassembled and mounted on the chair using two fasteners such as bolts, screws, or the like per armrest.

It is believed that the present invention and many of its attendant advantages will be understood by the foregoing description. It is also believed it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A tray attachment for a chair, comprising:

an adjustable mounting tube for mounting a tray connected to a first support arm of the chair;

a slider extension tube disposed within the mounting tube for supporting the tray;

a lateral support assembly mechanically coupled to the slider extension tube for providing lateral stability of the tray; and a vertical support assembly mechanically coupled to the slider extension tube for providing vertical stability of the tray, the vertical support assembly being shorter in length than the lateral support assembly, wherein the slider extension tube rotates as the tray is moved from a stored position to a utilization position, such rotation placing the lateral support assembly adjacent to a vertical edge of the tray and the vertical support assembly underneath the tray.

2. The tray attachment as claimed in claim 1, wherein the tray is mountable by mechanically coupling the mounting tube to the first support arm.

3. The tray attachment as claimed in claim 1, wherein the lateral support assembly and the vertical support assembly are coupled to the slider extension tube on a forward side of the mounting tube.

4. The tray attachment as claimed in claim 1, wherein the lateral support assembly and the vertical support assembly rotate from a horizontal position to a vertical position when the tray is moved from the storage position to the utilization position.

5. The tray attachment as claimed in claim 1, wherein the lateral support assembly is suitable for holding the tray when the tray is in a storage position.

6. The tray attachment as claimed in claim 1, wherein in the utilization position the tray is laterally supported by the lateral support assembly and vertically supported by the vertical support assembly.

7. The tray attachment as claimed in claim 1, further comprising a swivel assembly coupled to the slider extension tube via a right angle extension suitable for coupling the slider extension tube to the tray.

8. The tray attachment as claimed in claim 1, further comprising a tray support assembly mounted on a second support arm of the chair for supporting an opposite forward edge of the tray.

9. The tray attachment as claimed in claim 8, wherein the tray support assembly comprises at least two tubes coupled to one another by at least four sets of clamps.

10. A tray assembly for a chair, comprising:

a tray for providing a working surface area;

a tray attachment for attaching the tray to the chair, the tray attachment comprising, a mounting tube for mounting the tray mechanically coupled to a first support arm of the chair;

a slider extension tube disposed within the mounting tube for supporting the tray;

a lateral support assembly comprising a mechanically coupled to the slider extension tube for providing lateral stability for the tray;

a vertical support assembly mechanically coupled to the slider extension tube for providing vertical stability for the tray; and a tray support assembly mechanically coupled to a second support arm of the chair suitable for supporting an opposite forward edge of the tray further comprising at least two tubes coupled to one another by at least four sets of clamps, the at least two tubes being rotatable with respect to each tube to increase or decrease the operating height and horizontal location of the tray with respect to the slider extension tube, wherein the slider extension tube rotates as the tray is moved from a stored position to a utilization position, such rotation places the lateral support assembly adjacent to a vertical edge of the tray and the vertical support assembly beneath the tray, thereby providing a lateral rotation stop and a vertical rotation stop for the tray.

11. The tray assembly as claimed in claim 10, wherein the tray is mountable by mechanically coupling the mounting tube to a chair armrest tube.

12. The tray assembly as claimed in claim 10, wherein the lateral support assembly and the vertical support assembly are coupled to the slider extension tube on a forward side of the mounting tube.

13. The tray assembly as claimed in claim 10, wherein the stored position of the tray is supported by the lateral support assembly.

14. The tray assembly as claimed in claim 10, the tray is laterally supported by lateral support assembly and vertically supported by the vertical support assembly when the tray is in the utilization position.

15. The tray assembly as claimed in claim 10, further comprising a swivel assembly for coupling the slider extension tube to the tray.

16. The tray assembly as claimed in claim 15, wherein the swivel assembly is coupled to the slider extension tube via a right angle extension.

17. The tray assembly as claimed in claim 10, wherein the lateral support assembly is longer in length than the vertical support assembly.

18. The tray assembly as claimed in claim 10, wherein the lateral support assembly and the vertical support assembly rotate from a horizontal position to a vertical position when the tray is moved from the storage position to the utilization position.

19. A tray assembly for a chair, comprising:

a tray for providing a working surface area;

a tray attachment for attaching the tray to the chair, the tray attachment comprising, a first mounting tube for mounting the tray mechanically coupled to a first support arm of the chair;

a slider extension tube disposed within the mounting tube for supporting the tray;

a lateral support assembly comprising a mechanically coupled to the slider extension tube for providing lateral stability for the tray;

a vertical support assembly mechanically coupled to the slider extension tube for providing vertical stability for the tray, the vertical support assembly being shorter than the lateral support assembly; and a tray support assembly mechanically coupled to a second support arm of the chair suitable for supporting an opposite forward edge of the tray further comprising at least two tubes coupled to one another by at least four sets of clamps, the at least two tubes being rotatable with respect to each tube to increase or decrease the operating height and horizontal location of the tray with respect to the slider extension tube, wherein the slider extension tube rotates as the tray is moved from a stored position to a utilization position, such rotation places the lateral support assembly adjacent to a vertical edge of the tray and the vertical support assembly beneath the tray, thereby providing a lateral rotation stop and a vertical rotation stop for the tray.

20. The tray assembly as claimed in claim 19, wherein the lateral support assembly and the vertical support assembly rotate from a horizontal position to a vertical position when the tray is moved from the storage position to the utilization position.

* * * * *